US010532398B2

(12) United States Patent
Ballu et al.

(10) Patent No.: US 10,532,398 B2
(45) Date of Patent: Jan. 14, 2020

(54) ENCLOSURE HAVING A SEALING DEVICE FOR A CASTING INSTALLATION

(71) Applicant: CONSTELLIUM ISSOIRE, Issoire (FR)

(72) Inventors: Arnaud Ballu, Biviers (FR); Bernard Valentin, Voiron (FR); Soizic Blais, Saint Etienne de Crossey (FR)

(73) Assignee: CONSTELLIUM ISSOIRE, Issoire (FR)

( * ) Notice: Subject to any disclaimer, the term of this patent is extended or adjusted under 35 U.S.C. 154(b) by 0 days.

(21) Appl. No.: 16/076,723

(22) PCT Filed: Mar. 8, 2017

(86) PCT No.: PCT/FR2017/050516
§ 371 (c)(1),
(2) Date: Aug. 9, 2018

(87) PCT Pub. No.: WO2017/158259
PCT Pub. Date: Sep. 21, 2017

(65) Prior Publication Data

US 2019/0060984 A1 Feb. 28, 2019

(30) Foreign Application Priority Data

Mar. 18, 2016 (FR) ..... 16 52343

(51) Int. Cl.
*B22D 11/049* (2006.01)
*B22D 11/14* (2006.01)
(Continued)

(52) U.S. Cl.
CPC ..... *B22D 9/003* (2013.01); *B22D 7/005* (2013.01); *B22D 11/003* (2013.01);
(Continued)

(58) Field of Classification Search
CPC ..... B22D 11/003; B22D 11/049; B22D 11/14; B22D 11/148
See application file for complete search history.

(56) References Cited

U.S. PATENT DOCUMENTS 4,930,566 A 6/1990 Yanagimoto et al.
5,168,918 A 12/1992 Okuda et al.
(Continued)

OTHER PUBLICATIONS

International Search Report, dated Jul. 4, 2017, corresponding to International Application No. PCT/FR2017/05016.

*Primary Examiner* — Kevin E Yoon
(74) *Attorney, Agent, or Firm* — Ladas & Parry LLP; Malcolm J. MacDonald

(57) ABSTRACT

An enclosure having a sealing device, for a casting installation, having a first body and a second body that is removably joined to the first body along a bearing axis, the first and second bodies together delimiting an internal chamber. The sealing device comprises: at least one compression member, at least one seal having a lateral contact face extending substantially parallel to the bearing axis; the compression member and the seal being arranged with respect to one another such that the compression member is in contact with the lateral contact face of the seal and exerts a compression force thereon that is oriented orthogonally to the bearing axis.

15 Claims, 6 Drawing Sheets

(51) Int. Cl.

| | |
|---|---|
| ***B22D 11/00*** | (2006.01) |
| ***B22D 9/00*** | (2006.01) |
| ***B22D 7/00*** | (2006.01) |
| ***C22C 1/02*** | (2006.01) |

(52) U.S. Cl.
CPC ..... *B22D 11/049* (2013.01); *B22D 11/148* (2013.01); *C22C 1/026* (2013.01)

(56) References Cited

U.S. PATENT DOCUMENTS

| | | | | |
|---|---|---|---|---|
| 8,365,808 | B1 | 2/2013 | Tilak et al. | |
| 2004/0206471 | A1* | 10/2004 | Blejde ..... | B22D 11/0622 164/428 |
| 2004/0244940 | A1* | 12/2004 | Nakayama ..... | B22D 11/0622 164/428 |
| 2016/0237532 | A1 | 8/2016 | Danielou et al. | |

* cited by examiner

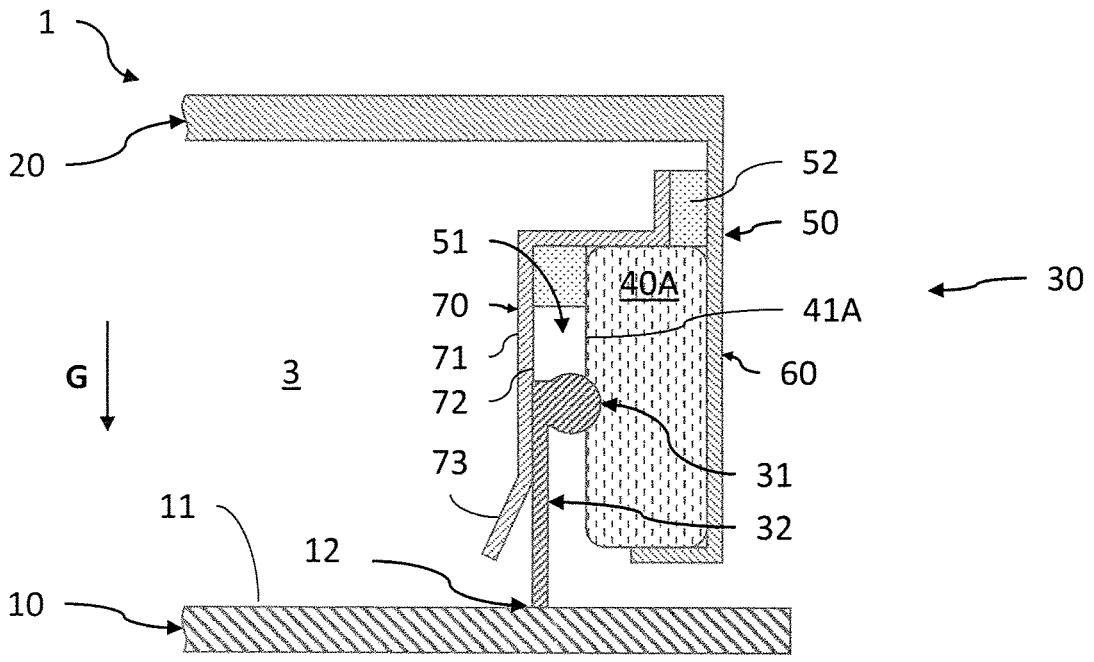
Fig.3
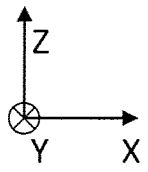

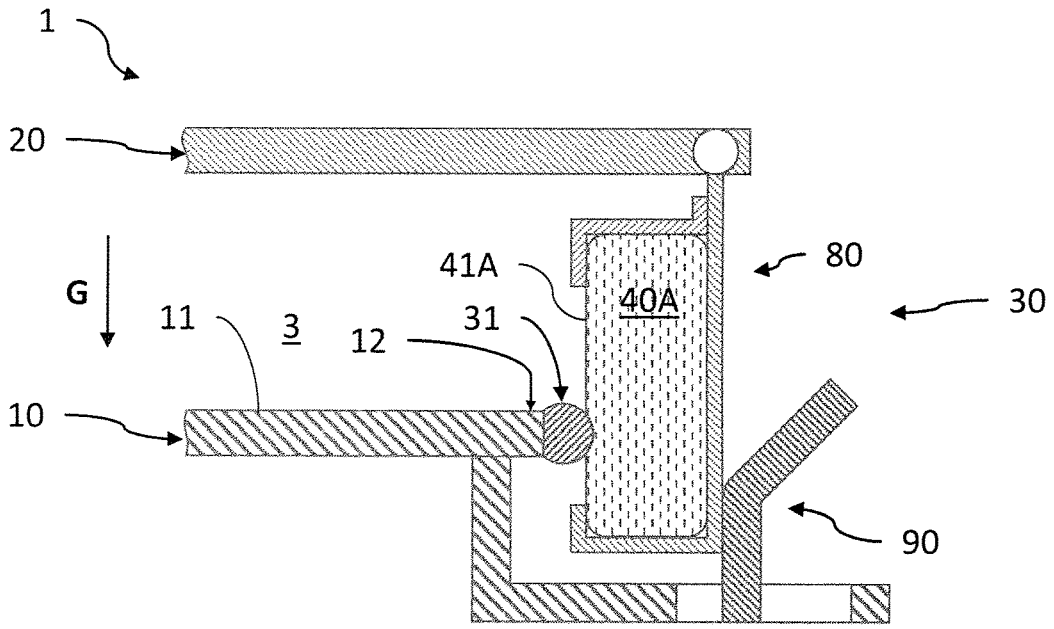
Fig.5
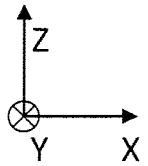

ENCLOSURE HAVING A SEALING DEVICE FOR A CASTING INSTALLATION

TECHNICAL FIELD

The field of the invention is that of casting installation enclosures, for example enclosures suitable for operations relating to aluminum alloy casting, such as operations for melting, storage, treatment and solidification of liquid metal, these enclosures including a first body and a second body joined to the first body in a tight manner, for example a holder and a lid delimiting together an internal chamber intended to receive the liquid metal.

STATE OF THE RELATED ART

In the field of metallurgy, as in other technical fields, use is made of enclosures formed from a holder and a lid removably joined to the holder, defining together an internal chamber wherein the tightness must be ensured between these two components, for example in the case of controlling the proportion of a gas of interest possibly present in the internal chamber.

Such is the case of casting installation enclosures, for example aluminum and lithium alloy casting installation enclosures, where it is important to control in particular the oxygen content possibly present in the internal chamber of the enclosure. Indeed, aluminum and lithium alloys tend to become oxidized, which may give rise to a degradation of the mechanical properties of the solidified alloy.

The document U.S. Pat. No. 4,930,566 describes an example of an enclosure of a solidification device of an aluminum and lithium alloy casting installation. The enclosure includes herein a lid and a casting table delimiting together the internal chamber, the lid being herein fixed, i.e. non-removably joined, to the casting table. However, it may be necessary to have access to the internal chamber of the enclosure.

As such, and with reference to FIG. 1, the document WO2015/086921 describes an example of an enclosure 1 of a solidification device of an aluminum and lithium alloy casting installation, the enclosure 1 including a holder 10, herein a casting table, whereon rests, along a bearing axis G, a removable lid 20, the holder 10 and the lid 20 delimiting together an internal chamber 3 wherein the liquid metal to be solidified is situated.

A seal 40 extends herein peripherally between the casting table 10 and the lid 20 so as to ensure the tightness of the enclosure 1 between these two components. Under the effect of a compression force applied by the lid on the seal 40 along the bearing axis G of the lid 20 on the holder 10, the seal 40 is subject to compressive stress resulting in a vertical deformation of the seal, i.e. a deformation along the axis G, which makes it possible to obtain the desired tightness between the lid 20 and the holder 10.

However, the enclosure 1 is liable to exhibit a local loss of tightness between the holder 10 and the lid 20, particularly when the bearing surface 11 of the holder 10 is not planar and/or when the holder 10 and the lid 20 are subject locally to a relative separation due to a heat expansion differential between the holder 10 and the lid 20. Furthermore, the assembly between the holder 10 and the lid 20 may be rendered difficult insofar as it is dependent in particular on the intensity of the compression force that it is necessary to apply to the seal 40 to obtain the sought deformation and thereby ensure the tightness between the holder 10 and the lid 20.

DESCRIPTION OF THE INVENTION

The aim of the invention is that of resolving at least in part the drawbacks of the prior art, and more particularly that of providing a casting installation enclosure with enhanced tightness.

A further aim of the invention is that of providing a casting installation enclosure wherein the assembly between the first body and the second body is substantially independent of the intensity of the compression force to be applied to the seal.

For this, the subject matter of the invention is a casting installation enclosure having a first body, and a second body that is removably joined to the first body along a bearing axis, the first and second bodies delimiting together an internal chamber. According to the invention, it includes a sealing device comprising:

- at least one compression member, tightly joined to the first body;
- at least one seal, tightly joined to the second body, having a lateral contact face extending substantially parallel to the bearing axis;
- the compression member and the seal being arranged with respect to one another such that the compression member is in contact with the lateral contact face of the seal and exerts a compression force thereon that is oriented substantially orthogonally to the bearing axis, thereby ensuring the tightness of the enclosure between the first and second bodies.

Some preferred but non-limiting aspects of this enclosure are as follows.

The seal and the compression member extend longitudinally at the level of a peripheral edge of the enclosure. The seal and the compression member each extend along a closed continuous loop.

The first and second bodies may be joined to one another with a degree of freedom in local relative movement along the bearing axis, the compression member remaining in contact with the lateral contact face of the seal.

The compression member may be in contact with the lateral contact face of the seal on a so-called transversal surface, along the bearing axis, less than or equal to 50% of a mean height of the lateral contact face.

The compression member may be in contact with the lateral contact face of the seal on a so-called transversal surface, along the bearing axis, situated at a distance from the transversal ends of the lateral contact face.

The deformation ratio of the seal under the effect of the compression force, along an axis substantially orthogonal to the bearing axis, may be less than or equal to 20%.

The seal may be attached to a peripheral sleeve, the latter being movably joined to the second body so as to be able to separate the lateral contact face from the compression member when the first and second bodies are not joined to one another.

A holding member may be joined to the first body, and may be arranged such that, when the first and second bodies are joined to one another, the peripheral sleeve is positioned between the holding member and the compression member, the compression member being in contact with the lateral contact face and exerts a compression force thereon, the peripheral sleeve being further locked in transversal translation by the holding member and the compression member.

The holding member may be suitable for carrying out, when the first and second bodies are joined to one another, locking in movement of the peripheral sleeve so as to prevent any relative separation between the compression member and the seal along the axis of said compression force exerted.

The holding member may include a locking portion joined to the first body and including a limit stop surface extending substantially parallel to the bearing axis, and an engagement portion, joined to the locking portion, and including an inclined engagement surface with respect to the limit stop surface.

The compression member may be situated at a transversal end of a peripheral rib attached to the first body and extending transversally substantially parallel to the bearing axis.

The seal may be situated in a peripheral casing joined to the second body, including a peripheral internal housing extending transversally substantially parallel to the bearing axis, at least partially delimited by the lateral contact face of the seal, the compression member and at least a part of the peripheral rib being engaged in the internal housing, a mean width of the internal housing being less than a transversal dimension of the compression member.

A second seal may be situated in the peripheral casing, and may include a lateral contact face situated facing the lateral contact face of the first seal, said lateral contact faces delimiting together a mean width of the internal housing, the compression member being in contact with said lateral contact faces and exerting a compression force thereon that is oriented essentially orthogonally to the bearing axis.

The peripheral rib may exhibit a mean thickness, along a transversal axis substantially orthogonal to the longitudinal axis of the peripheral rib and to the bearing axis, less than a lateral dimension of the compression member along said transversal axis, the mean thickness being less than the mean width of the internal housing.

The invention also relates to a method for assembling the enclosure according to any one of the preceding features, wherein the second body is deposited on the first body along the bearing axis, the compression member coming into contact with the lateral contact face of the seal and exerts thereon a compression force that is oriented substantially orthogonally to the bearing axis.

The invention also relates to an aluminum alloy casting installation, including an enclosure according to any one of the preceding features.

BRIEF DESCRIPTION OF THE FIGURES

Further aspects, aims, advantages and features of the invention will emerge more clearly on reading the following detailed description of preferred embodiments thereof, given by way of non-limiting example, with reference to the appended figures, besides FIG. 1 already described, wherein:

FIG. 3 is a partial, schematic and cross-sectional view of an enclosure having a sealing device according to an alternative embodiment of the first embodiment, in the engaged position thereof;

FIG. 5 is a partial, schematic and cross-sectional view of an enclosure having a sealing device according to an alternative embodiment of the second embodiment, in the engaged position thereof.

DETAILED DESCRIPTION OF PARTICULAR EMBODIMENTS

In the figures and hereinafter in the description, the same references represent identical or similar elements. Furthermore, the various elements are not represented to scale so as to prioritize the clarity of the figures. Moreover, the various embodiments and alternative embodiments are not mutually exclusive and may be combined with one another.

Figure 1:
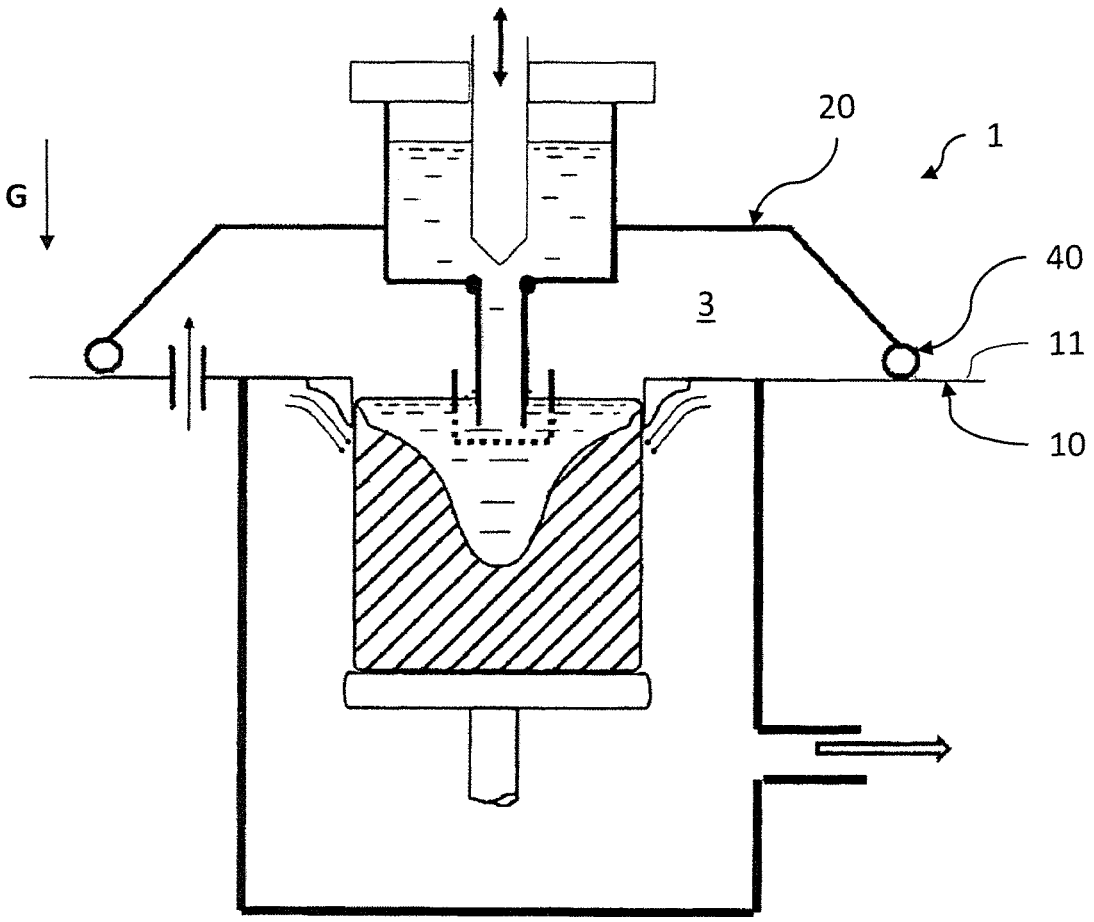
Fig.1 PRIOR ART
Figure 2A:
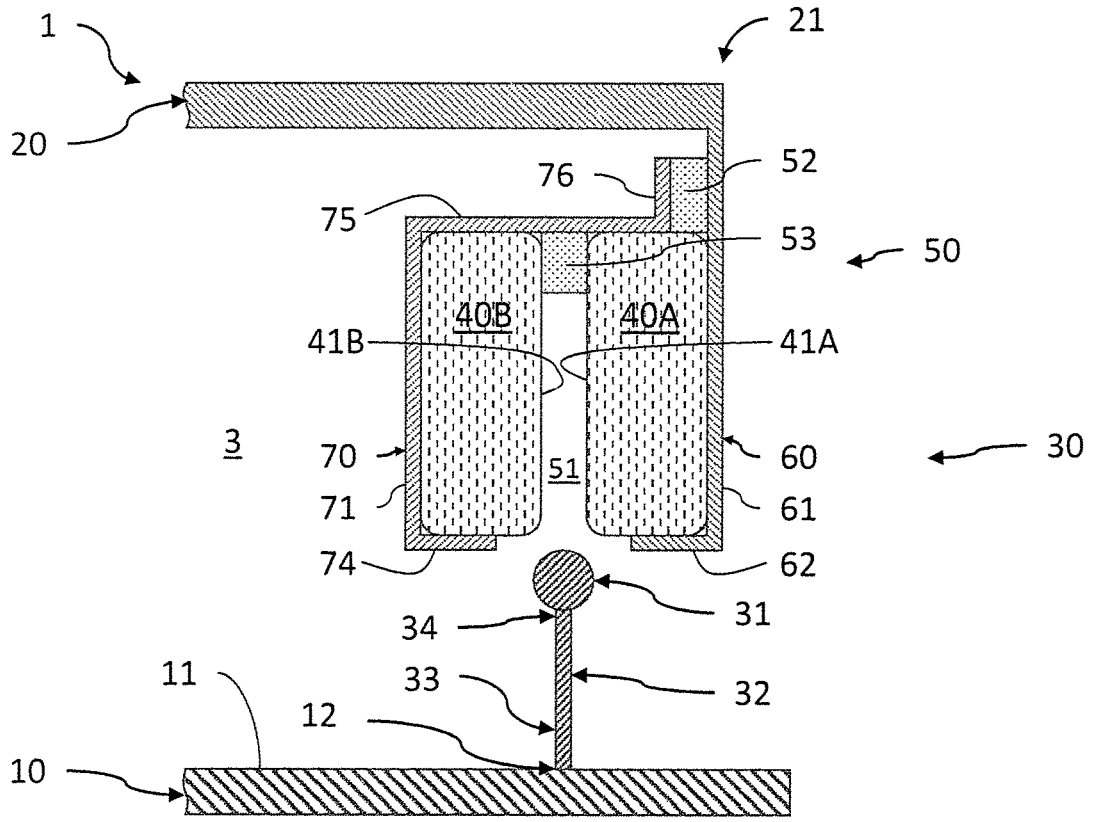
FIGS. 2A and 2B are partial, schematic and cross-sectional views of an enclosure having a sealing device according to a first embodiment, in a so-called disengaged position (FIG. 2A) and in a so-called engaged position (FIG. 2B)
Figure 2B:
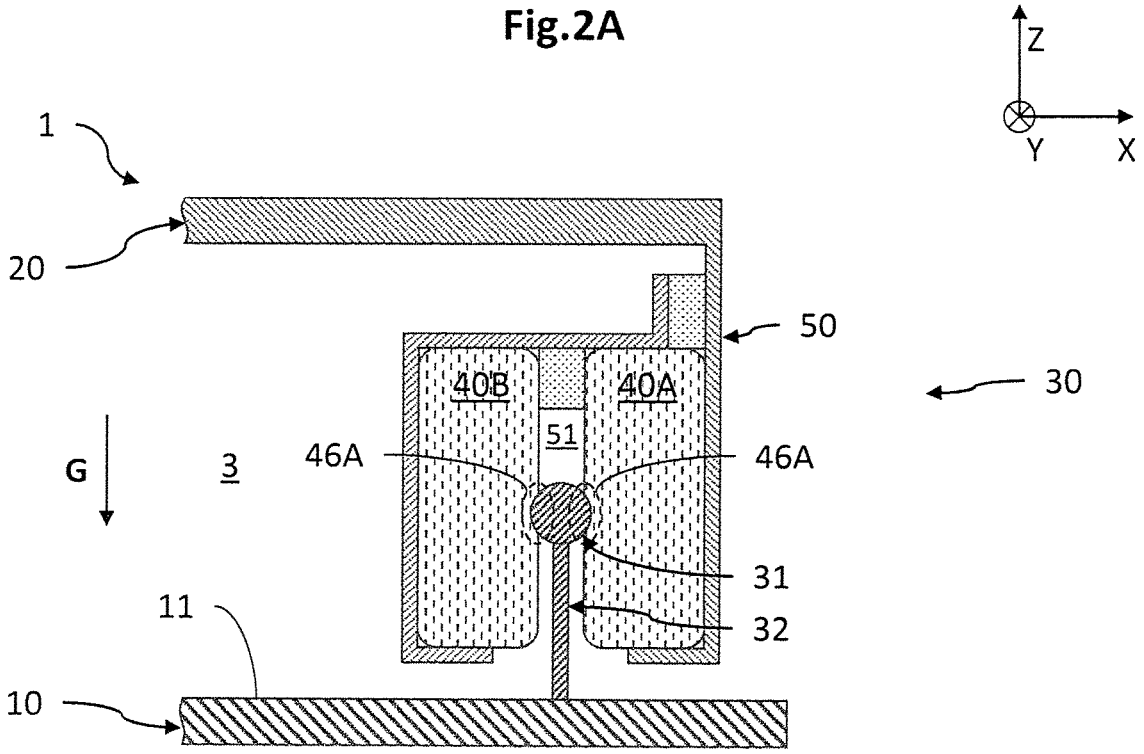

FIGS. 2A and 2B are partial, schematic and cross-sectional views of a casting installation enclosure 1 according to a first embodiment, equipped with a sealing device 30, in a so-called disengaged position (FIG. 2A) and in a so-called engaged position (FIG. 2B).

Herein and hereinafter in the description, a direct three-dimensional reference point (X,Y,Z) is defined, where the axes X and Y form a plane parallel to the principal plane of the holder 10, the axis X being oriented herein orthogonally to a peripheral edge of the enclosure 1 where the sealing device 30 is situated, and where the axis Z is oriented substantially orthogonally to the principal plane of the holder 10, and substantially parallel to the bearing axis G when the lid 20 rests on the holder 10, this bearing axis G being oriented along the gravitational axis. Hereinafter in the description, the terms "vertical" and "vertically" are understood to relate to an orientation substantially parallel to the axis Z, and the terms "horizontal" and "horizontally" are understood to relate to an orientation substantially parallel to the plane (X,Y). Moreover, the terms "bottom" and "top" are understood to relate to an increasing position on moving from the holder 10 along the direction +Z.

The enclosure 1 includes herein a first body 10, or bottom body, hereinafter referred to as holder, and a second body 20, or top body, hereinafter referred to as lid, removably joined to one another, such that the lid 20 rests on the holder 10 along a bearing axis G. The holder 10 and the lid 20 delimit together an internal volume, or internal chamber 3. The internal chamber 3 is as such at least partially delimited by the internal surface of the lid 20 and by that of the holder 10.

The enclosure 1 is suitable for belonging to a casting installation, i.e. an installation including devices for converting a metal in any form into an unwrought semi-finished product via the liquid phase. A casting installation may comprise numerous devices such as one or a plurality of furnaces necessary for melting the metal ("melting furnace") and/or for holding the temperature thereof ("holding furnace") and/or operations for preparing the liquid metal and/or adjusting the composition ("processing furnace"), one or a plurality of pots (or "ladles") intended to perform a treatment for removing impurities dissolved and/or suspended in the liquid metal. This treatment may consist of filtering the liquid metal on a filtering medium in a "filtering ladle" or introducing into the bath a so-called "treatment" gas that may be inert or reactive in a "degassing ladle". The casting installation may further include a device for solidifying the liquid metal (or "casting machine"), for example by vertical semi-continuous direct chill casting in a casting pit, optionally comprising devices such as a mold (or "ingot mold"), a device for supplying the liquid metal (or "spout") and a cooling system. These different furnaces, pots and solidification devices may be interconnected by transfer devices or channels known as "troughs" wherein the liquid metal may be transported.

In this example, merely by way of illustration, the enclosure 1 belongs to a device for solidifying an aluminum and lithium alloy by vertical semi-continuous casting of a casting installation, the tightness of the enclosure 1 making it possible to control the atmosphere above the liquid surface of the alloy during the solidification thereof.

The holder 10, herein a casting table, includes a peripheral top surface 11, or bearing surface, intended to receive a lid 20. This bearing surface 11 surrounds herein an ingot mold (not shown) suitable for receiving the liquid metal with a view to the direct chill solidification thereof.

The lid 20 is suitable for covering the holder 10 and for delimiting therewith an internal chamber 3 wherein the liquid metal is situated. It is thereby suitable for resting on the bearing surface 11 of the holder 10 along a bearing axis G, this axis being oriented along the gravitational axis. A part of the sealing device 30 is situated at the level of the peripheral edge 21 of the lid 20. The lid 20 is furthermore removable, and may be moved closer to or away from the holder 10 by translation and/or by rotation.

In the aim of ensuring the tightness of the enclosure 1 between the holder 10 and the lid 20, the enclosure 1 includes a sealing device 30 including at least one compression member 31 and at least one seal 40A intended to engage with one another when the holder 10 and the lid 20 are joined to one another.

The compression member 31 is joined tightly to the holder 10. It exhibits herein a cylindrical longitudinal shape with a rounded cross-section, herein substantially circular, extending longitudinally in the plane (X,Y) at the level of the peripheral edge of the enclosure 1, facing the bearing surface 11 of the holder 10. Advantageously, the compression member 31 extends continuously along a peripheral edge 12 of the holder 10 and follows a linear curve wherein both ends are joined, thereby forming a closed continuous loop. By way of illustration, it may be made of a metallic material and may have a transversal dimension, or diameter, of the order of one to a few centimeters. The term rounded cross-section denotes that the compression member has a surface having no sharp edges or salient angles liable to degrade the seal.

In this example, the compression member 31 is situated at the level of a transversal end 34 of a peripheral rib 32 extending longitudinally in the plane (X,Y), and transversally along the vertical axis Z from the bearing surface 11 of the holder 10. The peripheral rib 32 thereby exhibits a length corresponding to the longitudinal span thereof in the plane (X,Y), a mean height corresponding to the dimension thereof along the vertical axis Z, and a mean thickness along the axis X. It is fixed tightly to the holder 10 at the level of a bottom transversal end 33 and includes the compression member 31 at the level of the opposite transversal end 34. Advantageously, the mean thickness of the peripheral rib 32 is less than the transversal dimension of the compression member 31. By way of illustration, the peripheral rib 32 may be made of a metallic material and be integral, i.e. made of a single piece and of the same material, with the compression member 31. It may exhibit a mean height of the order of a few centimeters, for example between 1 cm and 10 cm, and may exhibit a thickness of the order of a few millimeters.

The seal 40A is joined tightly to the lid 20. It has a substantially square or rectangular cross-section, herein a rectangular cross-section, and extends longitudinally in the plane (X,Y) facing the compression member 31. It includes a lateral so-called contact face 41A extending transversally substantially parallel to the bearing axis G. By way of illustration, the seal 40A is made of a deformable tight material wherein the mechanical properties are not substantially degraded at temperatures of the order of one to several hundred degrees Celsius, for example of the order of 100° C. to 200° C. or more, such as an elastomeric material or an alveolate silicone material. It may exhibit a mean thickness along the axis X of a few centimeters, included for example between 1 cm and 5 cm, and a mean height along the vertical axis Z of a few centimeters, included for example between 5 cm and 10 cm. The term substantially parallel denotes that the lateral contact face 41A extends transversally along the bearing axis G within more or less 10°, the height thereof being such that the compression member 31 remains in contact therewith when the lid 20 rests on the holder 10, despite any mechanical deformations of the lid 20 by buckling or kinking. As such, the height of the lateral contact face is defined as the effective height thereof, i.e. the vertical span thereof suitable for being in contact with the compression member 31. Advantageously, the seal 40A extends continuously along the peripheral edge of the lid 20. The seal 40A follows a linear curve wherein both ends close onto one another, thereby forming a closed continuous loop.

In this example, the seal 40A is positioned inside a rigid peripheral casing 50 joined tightly to the lid 20. The seal 40A forms a closed continuous loop, it goes around the lid 20. The peripheral casing 50 extends longitudinally in the plane (X,Y). It defines an internal housing 51 at least partially delimited by the lateral contact face 41A of the seal 40A, this internal housing being suitable for receiving the compression member 31 and at least a part of the peripheral rib 32. The peripheral casing 50 may extend in the plane (X,Y) continuously or discontinuously. In the latter case, it may be formed from a plurality of mutually separate portions, these portions being suitable for being adjoined in pairs along the longitudinal axis tightly when the lid 20 is joined to the holder 10.

The peripheral casing 50 includes a rigid outer wall 60 wherein the shape is suitable for receiving and holding the peripheral seal 40A in position. The outer wall 60 thereby includes a vertical portion 61 and a horizontal bottom portion 62 receiving a lateral face opposite the lateral face 41A and a bottom face of the seal 40A, respectively.

In this example, the peripheral casing 50 houses a second seal 40B. The latter is arranged opposite along the axis X of the first seal 40A, and exhibits a cylindrical shape with a substantially rectangular cross-section. It thereby includes a lateral contact face 41B extending transversally along the bearing axis G, situated facing the first lateral contact face 41A. By way of illustration, the second seal 40B is identical or similar to the first seal 40A in terms of material and dimensions. The seal 40B forms a closed continuous loop, it goes around the lid 20.

The peripheral casing 50 includes a rigid inner wall 70 wherein the shape is suitable for receiving and holding the second peripheral seal 40B in position. The inner wall 70 thereby includes a vertical portion 71 and a horizontal bottom portion 74 receiving the second seal 40B. The inner wall 70 further includes a top portion 75 whereby it is joined to the outer wall 60 of the peripheral casing 50. In this example, and optionally, to enable a clearance of the inner wall 70 with respect to the outer wall 60, and therefore a separation or approach of the two seals 40A, 40B along the axis X, the inner wall 70 is joined to the outer wall 60 by a soft or flexible link, herein a pivot link formed by a deformable assembly joint 52 positioned between the vertical portion 61 of the outer wall 60 and a top vertical portion 76 of the inner wall 70.

Moreover, so as to maintain a substantially constant separation over time between the two seals 40A, 40B, a holding joint 53 is positioned between the two seals 40A, 40B, being in contact with the respective top end of the lateral contact faces 41A, 41B.

The peripheral casing 50 defines a peripheral internal housing 51 extending transversally substantially parallel to the bearing axis G. It exhibits a mean width, i.e. a space along the axis X separating the two facing lateral contact faces 41A, 41B. The mean width of the internal housing 51 is preferably substantially constant along the transversal axis Z and along the longitudinal axis Y. This internal housing 51 is intended to receive the compression member 31 and at least a part of the peripheral rib 32, the mean width of the internal housing 51 being less than the transversal dimension of the compression member 31.

The method for assembling the lid 20 on the holder 10 is now described.

FIG. 2A illustrates the step wherein the lid 20 is positioned facing the holder 10 such that the internal housing 51 of the peripheral casing 50 is facing, i.e. at right angles with, or perpendicular to, the compression member 31 and the peripheral rib 32. In this, so-called disengaged, position, the internal housing 51 of the peripheral casing 50 does not yet receive the compression member 31.

FIG. 2B illustrates the next step wherein the lid 20 is rested on the holder 10 along the bearing axis G. During this step, the engagement, i.e. the insertion, of the compression member 31 and of at least a part of the peripheral rib 32 inside the peripheral internal housing 51 of the peripheral casing 50 is carried out. This engagement may be performed by a translation and/or a rotation of the lid toward the holder. In doing so, insofar as the transversal dimension of the compression member 31 is greater than the mean width of the internal housing 51, the compression member 31 comes into contact with the lateral contact face 41A of the seal 40A as well as that 41B of the second seal 40B. The compression member 31 thus exerts a compression force that is oriented substantially orthogonally to the bearing axis G, i.e. herein along the axis X, giving rise to compression stress in the seal 40A resulting in a deformation thereof, this deformation thus ensuring the tightness of the enclosure 1 between the holder 10 and the lid 20. A similar deformation of the additional seal 40B is obtained which enhances the sealing quality.

The term substantially orthogonal to the bearing axis denotes that the compression axis applied to the lateral contact face 41A of the seal 40A is orthogonal to the bearing axis G within more or less 10°. In other words, the value of the component along the bearing axis G of the compression force is less than approximately 20% of the value of the component orthogonal to the axis G, oriented herein along the axis X. It is further understood that the compression force is oriented substantially orthogonally to the longitudinal axis, herein the axis Y, along which extend the seal 40A and the compression member 31.

As such, insofar as the compression member 31 and the seal 40A are arranged with respect to one another such that the compression member 31 is in contact with the lateral contact face 41A of the seal 40A and exerts thereon a compression force that is oriented substantially orthogonally to the bearing axis G, the sealing device 30 has the advantage of enhancing the tightness between the lid 20 and the holder 10 with respect to the example of the prior art mentioned above. Indeed, sealing is obtained by a lateral compression of the seal 40A and not by a vertical compression thereof. Sealing may thus be maintained in the case where the bearing surface 11 of the holder 10 whereon rests the lid 20 is not perfectly planar and/or in the case where the heat expansion differentials result locally in a vertical gap between the holder 10 and the lid 20. Indeed, such a vertical separation, due to an evenness defect or heat expansions, thereby leads to a modification of the vertical position of the compression member 31 relative to the seal 40A. In the example of the prior art, these vertical separations may induce a local loss of mechanical contact between the seal 40A and the holder 10 and/or the lid 20, and therefore form a localized leak degrading the tightness of the enclosure 1. In the invention, on the other hand, the compression member 31 remains in contact with the lateral contact face 41A of the seal 40A since the latter extends transversally substantially parallel to the bearing axis G. These vertical separations are particularly enabled when the holder 20 are joined to one another with a degree of freedom in local relative movement along the bearing axis G. Advantageously, the lengths of the closed continuous loops formed by the seal 40A and 40B have greater lengths than that formed by the compression member, typically of the order of 1 to 30%, preferentially of 1 to 10%. They are aligned with one another when the lid 20 rests on the holder 10.

Furthermore, the assembly of the lid 20 on the holder 10 of the enclosure 1 is particularly easy insofar as it is not substantially dependent on a vertical compression force to be applied to the seal 40A to obtain tightness, as in the example of the prior art mentioned above. In this example of the prior art, it may indeed be necessary to apply a compression force of high intensity to obtain a deformation of the seal which accounts for the evenness defects of the bearing surface 11 of the holder 10 and/or the heat expansion differentials, thereby ensuring tightness. In the invention, on the other hand, insofar as the deformation to be applied to the seal 40A to obtain tightness is independent of the vertical separations, it is then no longer necessary to apply a vertical compression force, rendering the assembly of the enclosure 1 easier and facilitating the positioning of the lid 20.

The lateral compression force applied by the compression member 31 on the lateral contact face 41A of the seal 40A results in a relative deformation, or deformation ratio, of the seal 40A along the axis X, which may be less than or equal to 20%, or even less than or equal to 10%. The compression ratio denotes herein the ratio $(e_0-e_c)/e_0$ where $e_0$ is the mean thickness, along the axis X, of the seal 40A without deformation, and $e_c$ is the minimum thickness of the deformed seal 40A along the compression axis applied by the compression member 31.

It is advantageous that the holder 10 and the lid 20 are joined to one another with a degree of freedom in local relative movement along the bearing axis G. In other words, the holder 10 and the lid 20 may exhibit locally a separation with respect to one another along the bearing axis G. The peripheral casing 50 is then not in mechanical contact with the holder 10, thereby allowing a local relative movement of the compression member 31 with respect to the seal 40A along the direction +Z, and more broadly along the bearing axis G, without affecting sealing quality, the compression member 31 remaining in contact with the lateral contact face 41A of the seal 40A, as well as, in this example, the second lateral contact face 41B. In the engaged position, the compression member 31 may then be in contact with the lateral contact face 41A of the seal 40A on a so-called transversal surface 46A, along the bearing axis G, situated at a distance from the transversal ends of the lateral contact face 41A along the bearing axis G. In other words, the compression member 31 is moved away from the bottom and top transversal ends, along the vertical axis Z, of the lateral contact face 41A, for example by a distance greater than or equal to once or twice the diameter thereof. It is preferably positioned substantially at the center of the lateral contact face(s) 41A, 41B along the vertical axis Z.

Furthermore, insofar as the compression member 31 is in contact with both lateral contact faces 41A, 41B of the seals 40A, 40B, a relative movement of the lid 20 with respect to the holder 10, in the plane (X,Y), does not give rise to a loss of contact between the compression member 31 and the seals 40A, 40B, which enhances the quality of the sealing and the insensitivity thereof to relative movements further.

Moreover, it is advantageous that the peripheral rib 32 exhibits a mean thickness, i.e. a transversal dimension along the axis X, less than the mean width of the internal housing 51 of the peripheral casing. As such, during the engagement and disengagement phases of the compression member 31 with respect to the internal housing 51, only the latter is in contact with the lateral contact faces 41A, 41B of the seals 40A, 40B, which limits the friction forces significantly and renders the assembly of the enclosure 1 easier.

In order to limit the friction forces further, it is advantageous that the contact member be in contact with the lateral contact face 41A of the seals 40A, 40B over a distance, along the bearing axis G, less than or equal to 50% of the value of the mean height of the lateral contact face 41A.

It is advantageous that the seals 40A, 40B be situated in a peripheral casing 50 including an inner wall 70, situated on the side of the internal chamber 3, wherein a vertical portion 71 extends vertically over the entire height of the seals 40A, 40B. As such, in the event of any spatter of liquid metal during the casting operation, the seals 40A, 40B are protected from thermal radiation as well as from any structural damage.

FIG. 3 is a partial, schematic and cross-sectional view of an enclosure 1 according to an alternative embodiment of the first embodiment, illustrated herein in the engaged position. In this example, the sealing device 30 is similar to that of the first embodiment and is essentially distinguished therefrom in that the peripheral casing 50 merely includes a single seal 40A and not two as illustrated in FIGS. 2A and 2B.

The compression member 31 is fixed herein to the peripheral rib 32 at the level of an outward flank of the vertical end 34, i.e. a flank oriented toward the outside of the internal chamber 3. The compression member is herein a longitudinal cylinder with a rounded cross-section, herein substantially circular, fixed for example by welding to peripheral rib 32. The rounded shape makes it possible not to damage the seal 40A when both elements are in contact. This also makes it possible to ensure contact between the two elements at a point in the plane (X, Z).

As such, the peripheral casing 50 includes, as in the first embodiment, an outer wall 60 which holds the seal 40A in position. It further includes an inner wall 70, joined to the outer wall 60 by a deformable assembly joint 52, which comprises a vertical portion 71 wherein the internal face 72 is on the side of the seal 40A, and delimits therewith the peripheral internal housing 51. As such, the mean width of the internal housing 51 is defined as the distance between the lateral contact face 41A and the internal face 72 of the inner wall 70. The peripheral casing may extend in the plane (X,Y) continuously or discontinuously. In the latter case, it may be formed from a plurality of mutually separate portions, these portions being suitable for being adjoined in pairs along the longitudinal axis tightly when the lid 20 is joined to the holder 10.

When the lid 20 and the holder 10 are joined to one another, the compression member 31 and at least a part of the peripheral rib 32 are engaged in the internal housing 51, such that the compression member 31 is in contact with the lateral face 41A of the seal 40A, on one hand, and the internal face 72 of the vertical portion 71, on the other. This engagement phase may be performed by moving the lid closer with respect to the holder in translation and/or in rotation. As such, the compression member 31 exerts a compression force on the lateral face 41A of the seal 40A that is oriented substantially orthogonally to the bearing axis G and to the longitudinal axis Y along which it extends.

The inner wall 70 includes herein a bottom part 73 of the vertical portion 71 thereof that is inclined with respect to the latter, such that the internal housing 51 exhibits a widening, or flaring, at the bottom, facilitating the engagement of the compression member 31 in the internal housing 51. The inner wall 70 may be continuous along the longitudinal axis thereof, or, advantageously, discontinuous, so as to limit friction during the engagement or disengagement phases.

Alternatively, the seal 40A may be arranged against the inner wall 70 of the peripheral casing 50, and not, as illustrated in FIG. 3, against the outer wall 60. In this case, the outer wall 60 may include a bottom part that is inclined with respect to the vertical portion 61 to form the bottom widening of the internal housing 51.

Figure 6A:
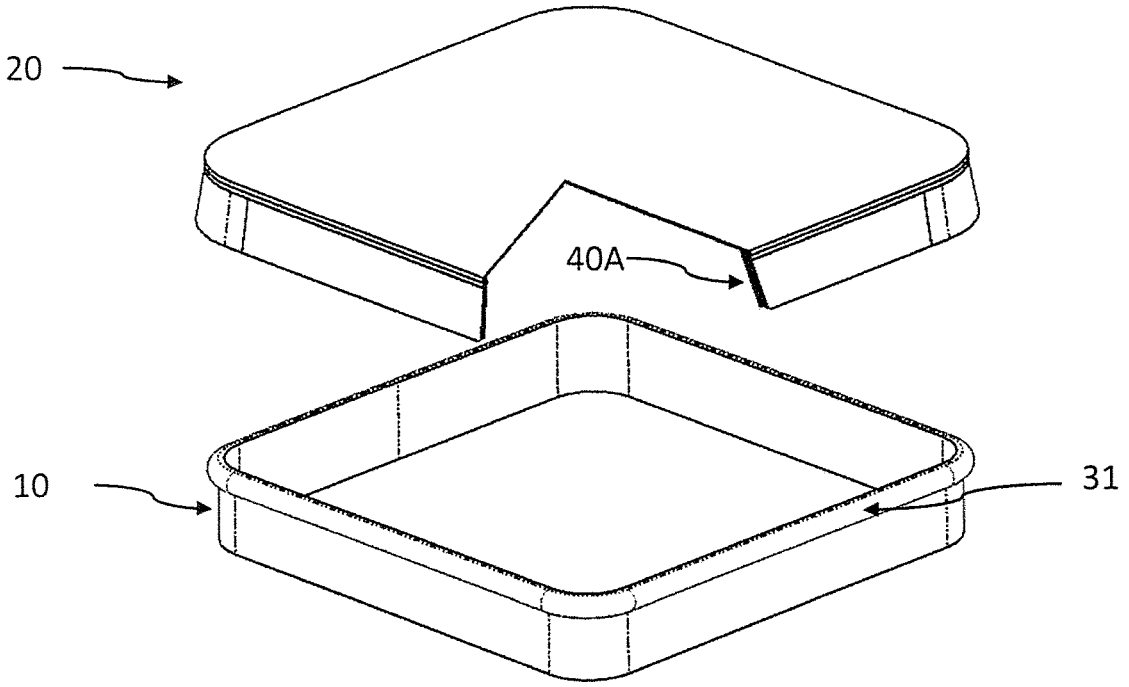
FIGS. 6A and 6B are perspective views of an enclosure having a sealing device according to the second embodiment.
Figure 6B:
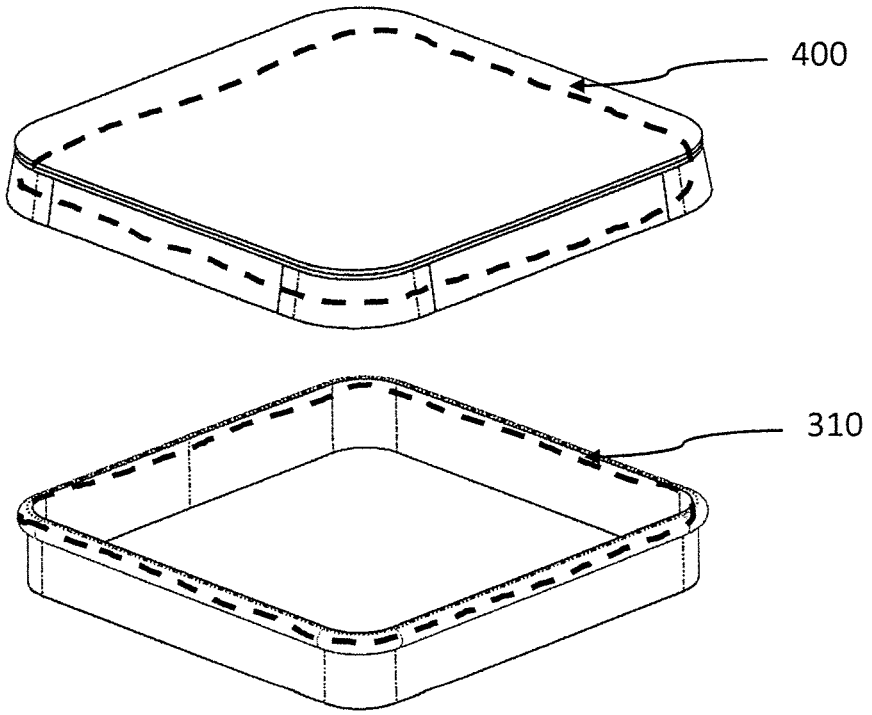

FIGS. 6A and 6B are perspective, schematic views of the lid 20 and of the holder 10. Advantageously, the compression member 31 extends continuously along a peripheral edge 12 of the holder 10 and follows a linear curve wherein both ends are joined, thereby forming a closed continuous loop 310, represented as a dotted line. Advantageously, the seal 40A extends continuously along the peripheral edge of the lid 20. The seal 40A follows a linear curve wherein both ends close onto each other, thereby forming a closed continuous loop 400 represented as a dotted line. Preferably, the length of the closed continuous loop 400 is greater than that of the compression member 310, typically of the order of 1 to 30%, preferentially of 1 to 10%. The two closed continuous loops are aligned when the lid 20 rests on the holder 10.

Figure 4A:
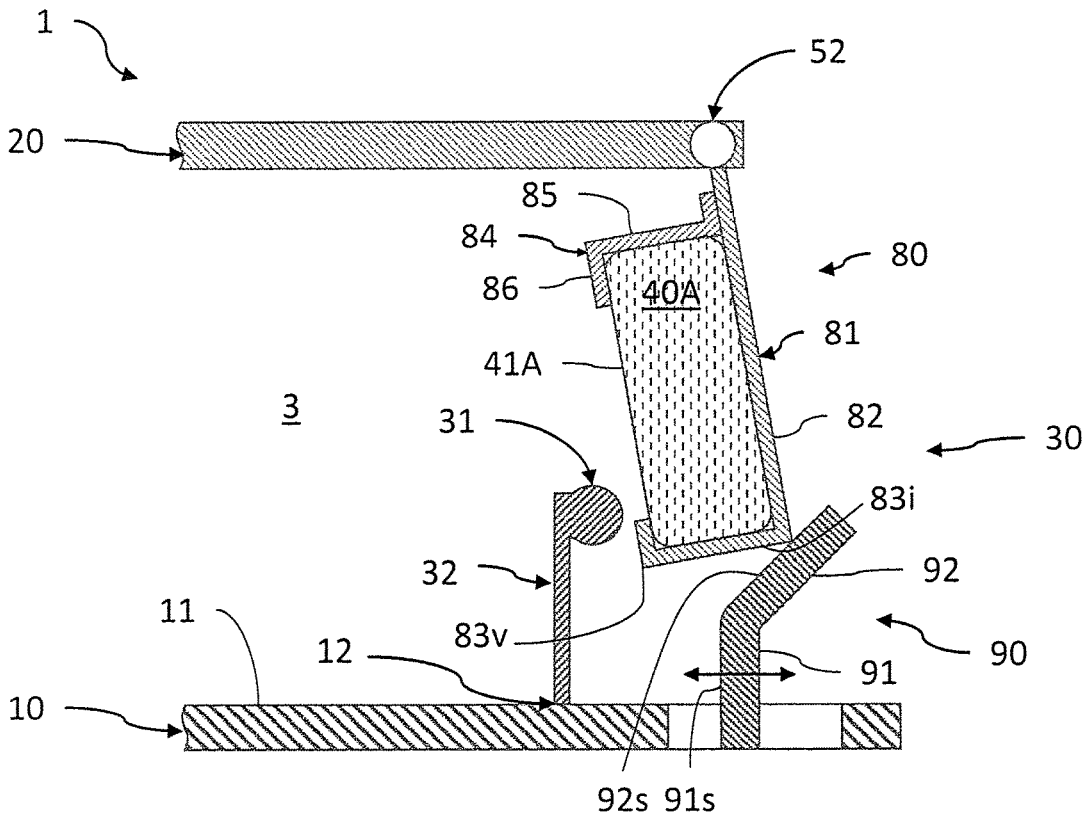
FIGS. 4A and 4B are partial, schematic and cross-sectional views of an enclosure having a sealing device according to a second embodiment, in a disengaged position (FIG.4A) and in an engaged position (FIG.4B)
Figure 4B:
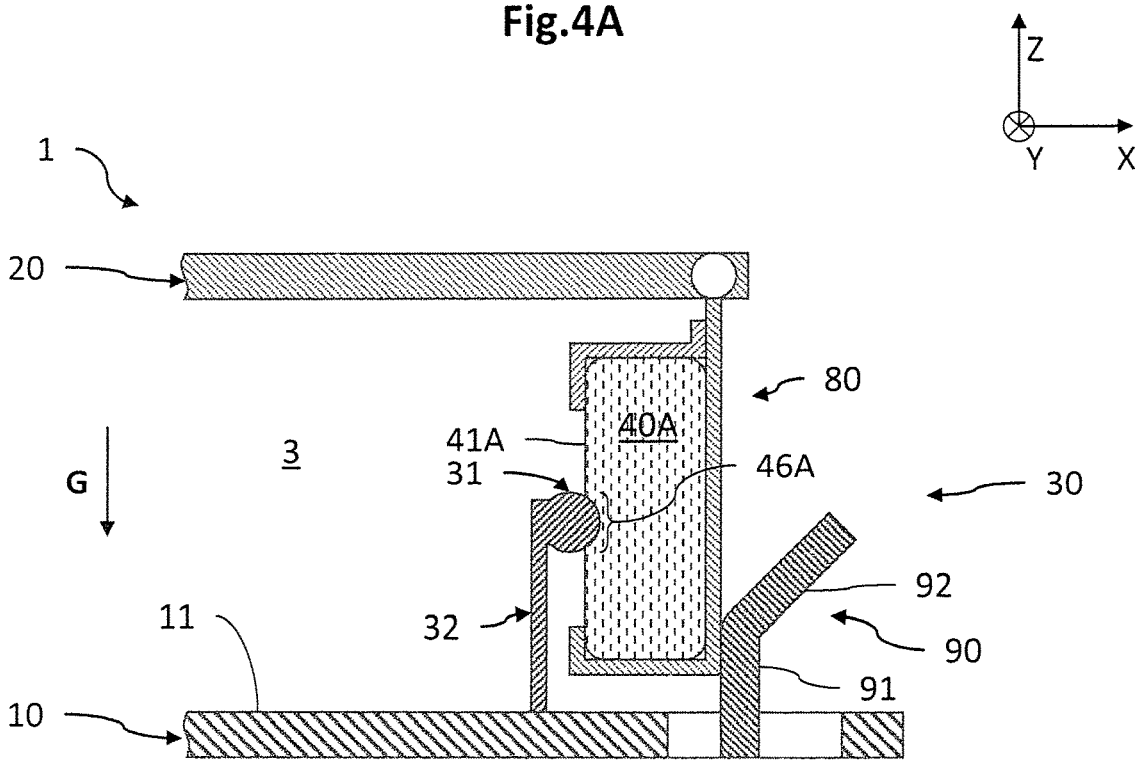

FIGS. 4A and 4B are partial, schematic and cross-sectional views of an enclosure 1 according to a second embodiment, in a disengaged position (FIG. 4A) and in an engaged position (FIG. 4B). The sealing 30 is distinguished herein essentially in that the seal 40A is not situated in a peripheral casing 50 including a peripheral internal housing 51 suitable for receiving the sealing member, but in a peripheral sleeve 80 holding the seal 40A.

In this example, the compression member 31 is similar or identical to that described in the alternative embodiment of the first embodiment described in FIG. 3.

The seal 40A is held in position in a peripheral sleeve 80 movably joined to the lid 20, such that the lateral contact face 41A is free, i.e. not completely covered by a wall of the peripheral sleeve 80. The peripheral sleeve 80 includes herein an outer wall 81 formed from a vertical portion 82 movably joined to the lid 20, a holding portion whereon rests the seal 40A, the latter being formed from a bottom part 83*i* extending from the vertical portion 82, and, advantageously, a vertical bottom part 83*v* extending from the bottom part 83*i*. It further includes an inner wall 84 formed from a top portion 85 fixed to the outer wall 81 which is extended by a vertical portion 86 which holds the seal 40A in position. As such, the seal 40A is held in position in the peripheral sleeve 80 particularly by the vertical top portion 86 and by the vertical bottom portion 83*v*. The peripheral sleeve 80 may extend in the plane (X,Y) continuously or discontinuously. In the latter case, it may be formed from a plurality of mutually separate portions, these portions being suitable for being adjoined in pairs along the longitudinal axis tightly when the lid 20 is joined to the holder 10.

In this example, the movable link 52 of the peripheral sleeve 80 with respect to the lid 20 is of the pivot link type but other types of mechanical link are possible, such as for example a slide link. The peripheral sleeve 80 exhibits herein a clearance angle, the latter being defined as the angle formed by the sleeve 80 between the vertical position thereof and the maximum inclined position thereof.

The sealing device 30 further includes at least one holding member 90 removably joined to the holder 10. As such, it consists of a plurality of locking tappets joined by slide link to the holder 10 and arranged regularly along the longitudinal axis Y. Each holding member 90 is arranged with respect to the compression member 31 such that, when the holder 10 and the lid 20 are joined to one another, the peripheral sleeve 80 (and therefore the seal 40A) is positioned between the holding member 90 and the compression member 31, the compression member 31 then being in contact with the lateral contact face 41A and exerts a compression force thereon. The peripheral sleeve 80 is then locked in transversal translation, i.e. held in the transversal direction, along the axis X, by the holding member 90 and the compression member 31. For this, the holding member 90 is brought into contact with the peripheral sleeve 80, herein of the outer wall 81, and locked in translation along the direction +X. The compression member 31 and the holding member 90 form together a peripheral housing suitable for receiving the peripheral sleeve 80 and therefore the seal 40A.

Advantageously, each holding member 90 includes a first locking portion 91 joined to the holder 10, and a second engagement portion 92 joined to the locking portion 91.

The locking portion 91 is herein joined to the holder 10, for example by a movable slide type link, and includes a limit stop surface 91*s* oriented on the side of the compression member 31, extending substantially parallel to the bearing axis G. It is intended to be in contact with the vertical portion 82 of the outer wall 81.

The engagement portion 92 is fixed to the locking portion 91 and includes an engagement surface 92*s* oriented on the side of the compression member 31 and situated in the extension from the limit stop surface 91*s*. It extends in an inclined manner with respect to the limit stop surface 91*s* so as to separate from the compression member 31 along the direction +Z, thereby forming a flaring of the peripheral housing facilitating the engagement of the peripheral sleeve 80, the angle of inclination being greater than the clearance angle of the peripheral sleeve 80. Advantageously, the engagement surface 92*s* is formed from a coating of a material suitable for limiting friction, for example polyamide, or has undergone a surface treatment suitable for limiting friction. Moreover, so as not to impede the engagement of the peripheral sleeve 80 in the peripheral housing, i.e. in the gap formed by the compression member 31 and the holding member 90, the height of the vertical bottom portion 83*v* is low, and more specifically less than the distance along the vertical axis Z between the compression member 31 and the bottom of the engagement portion 92, at the level of the join with the locking portion 91.

A step for assembling the lid 20 on the holder 10 is now described.

During a first phase, the peripheral sleeve 80 is moved closer to the holder 10 by translation and/or rotation of the lid 20, and comes into contact with the surface 92*s* of the engagement portion 92. As the lid 20 is moved closer to the holder 10, the outer wall 81 of the peripheral sleeve 80 slides along the engagement surface 92*s* such that the seal 40A is moved until it is oriented substantially parallel to the bearing axis G, and comes into the contact with the compression member 31 at the level of the lateral face 41A thereof. The latter then exerts thereon a lateral compression force.

During a second phase, the outer wall 81 of the peripheral sleeve 80 is in contact with the limit stop surface 91*s* of the locking portion 91, and slides along the latter along the bearing axis G. The seal 40A then moves with respect to the compression member 31 while maintaining mechanical contact therewith. The vertical compression applied to the seal 40A being low, it is not necessary to apply a high-intensity assembly force. Furthermore, the assembly force remains constant during this assembly phase, as it is not dependent on progressive vertical compression of the seal as in the example of the prior art mentioned above FIG. 5 is a partial, schematic and cross-sectional view of an enclosure 1 according to an alternative embodiment of the second embodiment. This alternative embodiment is distinguished essentially from the second embodiment in that the compression member 31 is situated at the level of a peripheral edge 12 of the holder 10 and not at the level of the top transversal end 34 of a peripheral rib 32.

As such, the holder 10 has a peripheral edge 12 extending at least partially along the circumference of the holder 10. The outer face of the peripheral edge 12 is formed by the compression member 31. A holding device includes a holding member 90 movably joined, herein by a slide link, to the holder 10. It further includes coupling plates 91 joining the holding member 90 to the holder 10.

In the engaged position, the peripheral sleeve 80 is positioned such that the lateral contact face 41A of the seal 40A is in contact with the compression member 31. Each locking tappet is then brought into contact with the peripheral sleeve 80 and locked in translation so as to keep the peripheral sleeve 80 locked in traversal movement along the axis X.

Particular embodiments have just been described. Various alternative embodiments and modifications will be obvious to those skilled in the art. As such, the compression member 31 may be joined to the lid 20 and the seal 40A be joined to the holder 10. Furthermore, the sealing device 30 may include a single seal 40A extending longitudinally in a continuous manner, or a plurality of seals adjoined to one another along the longitudinal axis. In the latter case, the peripheral casing 50, or if applicable the peripheral sleeve 80, may be formed from a plurality of mutually separate portions, suitable for being adjoined in pairs along the longitudinal axis tightly when the lid 20 is joined to the holder 10.

The invention claimed is:

1. A casting installation enclosure comprising:

a first body, and a second body that is removably joined to the first body along a bearing axis, the first and second bodies delimiting together an internal chamber, and a sealing device comprising:

a compression member, tightly joined to the first body;

a seal, tightly joined to the second body, having a lateral contact face extending substantially parallel to the bearing axis;

the compression member and the seal being arranged with respect to one another such that the compression member is in contact with the lateral contact face of the seal and exerts a compression force thereon that is oriented substantially orthogonally to the bearing axis, thereby ensuring the tightness of the enclosure between the first and second bodies.

2. The enclosure according to claim 1, wherein the seal and the compression member extend longitudinally at the level of a peripheral edge of the enclosure.

3. The enclosure according to claim 2, wherein the seal and the compression member each extend along a closed continuous loop.

4. The enclosure according to claim 1, wherein the first and second bodies are joined to one another with a degree of freedom in local relative movement along the bearing axis, the compression member remaining in contact with the lateral contact face of the seal.

5. The enclosure according to claim 1, wherein the compression member is in contact with the lateral contact face of the seal on a transversal surface, along the bearing axis, less than or equal to 50% of a mean height of the lateral contact face.

6. The enclosure according to claim 1, wherein the compression member is in contact with the lateral contact face of the seal on a transversal surface, along the bearing axis, situated at a distance from the transversal ends of the lateral contact face.

7. The enclosure according to claim 1, wherein the deformation ratio of the seal under the effect of the compression force, along an axis substantially orthogonal to the bearing axis, is less than or equal to 20%.

8. The enclosure according to claim 1, wherein:

the seal is attached to a peripheral sleeve, the latter being movably joined to the second body so as to be able to separate the lateral contact face from the compression member when the first and second bodies are not joined to one another, and a holding member is joined to the first body, and is arranged such that, when the first and second bodies are joined to one another, the peripheral sleeve is positioned between the holding member and the compression member, the compression member being in contact with the lateral contact face and exerts a compression force thereon, the peripheral sleeve being further locked in transversal translation by the holding member and the compression member, so as to prevent any relative separation between the compression member and the seal along the axis of said compression force exerted.

9. The enclosure according to claim 8, wherein the holding member comprises a locking portion joined to the first body and including a limit stop surface extending substantially parallel to the bearing axis, and an engagement portion, joined to the locking portion, and including an inclined engagement surface with respect to the limit stop surface.

10. The enclosure according to claim 1, wherein the compression member is situated at a transversal end of a peripheral rib attached to the first body and extending transversally substantially parallel to the bearing axis.

11. The enclosure according to claim 10, wherein the seal is situated in a peripheral casing joined to the second body, including a peripheral internal housing extending transversally substantially parallel to the bearing axis, at least partially delimited by the lateral contact face of the seal, the compression member and at least a part of the peripheral rib being engaged in the internal housing, a mean width of the internal housing being less than a transversal dimension of the compression member.

12. The enclosure according to claim 11, wherein a second seal is situated in the peripheral casing, including a lateral contact face situated facing the lateral contact face of the first seal, said lateral contact faces delimiting together a mean width of the internal housing, the compression member being in contact with said lateral contact faces and exerting a compression force thereon that is oriented essentially orthogonally to the bearing axis.

13. The enclosure according to claim 11, wherein the peripheral rib has a mean thickness, along a transversal axis substantially orthogonal to the longitudinal axis of the peripheral rib and to the bearing axis, less than a lateral dimension of the compression member along the same transversal axis, the mean thickness being less than the mean width of the internal housing.

14. A method for assembling the enclosure according to claim 1, wherein the second body is deposited on the first body along the bearing axis, the compression member coming into contact with the lateral contact face of the seal and exerts thereon a compression force that is oriented substantially orthogonally to the bearing axis.

15. An aluminum alloy casting installation, comprising the enclosure according to claim 1.

* * * * *